US005897477A

United States Patent [19]

Nakatogawa et al.

[11] Patent Number: 5,897,477

[45] Date of Patent: Apr. 27, 1999

[54] DEVELOPER CARRIER AND DEVELOPING APPARATUS COMPRISING THE SAME

[75] Inventors: Kenji Nakatogawa; Shigeo Ohta; Hiroshi Takayama, all of Ebina, Japan

[73] Assignee: Fuji Xerox Co., Ltd., Tokyo, Japan

[21] Appl. No.: 08/806,931

[22] Filed: Feb. 26, 1997

[30] Foreign Application Priority Data

Feb. 29, 1996 [JP] Japan ..... 8-069333

[51] Int. Cl.[6] ..... G03G 15/08

[52] U.S. Cl. ..... 492/56; 399/265; 399/279; 399/286

[58] Field of Search ..... 492/56; 399/265, 399/279, 286

[56] References Cited

U.S. PATENT DOCUMENTS 5,697,027 12/1997 Takagi et al. ..... 399/279

FOREIGN PATENT DOCUMENTS

A-63-31167 12/1988 Japan .
4-89876 3/1992 Japan .
A-4-166864 6/1992 Japan .
A-4-246676 9/1992 Japan .
A-6-242672 9/1994 Japan .
A-6-289697 10/1994 Japan .

OTHER PUBLICATIONS

Chemical Abstract 117:113629 (corresponds to JP 4–89876) Mar. 1992..

*Primary Examiner*—Mark Chapman
*Attorney, Agent, or Firm*—Oliff & Berridge, PLC

[57] ABSTRACT

A developer carrier comprising a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked. Also disclosed is a developing apparatus which comprises a developer carrier for retaining a developer on the surface thereof and for conveying the developer onto the position at which an electrostatic latent image formed on a latent image carrier is developed, wherein the developer carrier comprises a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked.

7 Claims, 8 Drawing Sheets

$$SR1r = \frac{a}{b} \times 100\ (\%)$$

SECONDARY ELECTRON IMAGE
( IN THE DIRECTION OF 0° )

SURFACE ANALYSIS MADE BY RD-500

SECONDARY ELECTRON IMAGE
( IN THE DIRECTION OF 0° )

SURFACE ANALYSIS MADE BY RD-500

SECONDARY ELECTRON IMAGE
( IN THE DIRECTION OF 0° )

SURFACE ANALYSIS MADE BY RD-500

DEVELOPER CARRIER AND DEVELOPING APPARATUS COMPRISING THE SAME

FIELD OF THE INVENTION

The present invention relates to a developing apparatus for visualizing a latent image formed on an image carrier, such as an electrophotographic photoreceptor or an electrostatic recording dielectric, by developing. More particularly, the present invention relates to an improved developer carrier for a magnetic one-component development system and to an improved developing apparatus which uses the developer carrier.

BACKGROUND OF THE INVENTION

There has been already known to externally add to the developing agent a substance for controlling the electrostatic charge amount of a dry magnetic one-component developer, i.e., dry silica.

It is widely known in the art that a developing apparatus using such a developer, when used, for example, in a thin developer layer form formed on a sleeve to develop a latent image, provides an image having an increased image density and being free from roughness, in comparison with a case where a latent image is developed using a developer without external addition of silica.

Various developing devices have already been proposed for maintaining superior developing characteristics of the developer.

For example, JP-A-63-311367 (The term "JP-A" as used herein means an "unexamined published Japanese patent application) discloses a developer carrier having thereon a resin layer having a resistance of from $10^9$ to $10^{13}$ Ω•cm. Further, JP-A-4-166864 discloses a developer carrier comprising graphite and positive-charged resin particles. Furthermore, JP-A-4-246676 discloses a developer carrier having specific surface roughness regulated by surface abrasion treatment.

JP-A-6-289697 discloses a developing apparatus in which a vibrating electric field is applied to a layer-thickness regulating member for a developer.

However, the developer carrier disclosed in JP-A-63-311367 has a high surface resistance and thus tends to cause development ghosts, which correspond to hysteresis of a printed pattern, on the developer carrier in the case, for example, where a developer having externally added a negative silica which is enduring for use in a negative developer.

In the developer carrier disclosed in JP-A-4-166864, the content of the positive-charged resin particles is limited, so that the positive-charged resin particles tends to be unevenly dispersed. Consequently, the resistance of a surface coating layer formed of the positive-charged resin particles becomes uneven, thereby easily causing leaks or development ghosts.

In the developer carrier disclosed in JP-A-4-246676, the developer surface becomes smooth by the surface abrasion treatment. As a result, the transfer amount of a developer is reduced, thereby resulting in a reduction in image density.

Further, in the developing apparatus disclosed in JP-A-6-289697, a vibrating electric field is applied to act on the layer-thickness regulating member for a developer layer for inhibiting reduction in image density, fogging of non-image areas and development ghosts. However, this technique is fundamentally technically disadvantageous because it arise an increase in costs resulting from the necessity of provision of an equipment for applying a vibrating electric field.

SUMMARY OF THE INVENTION

The present invention has been achieved to solve the above described problems in conventional techniques.

Therefore, an object of the present invention is to provide an inexpensive developer carrier capable of providing an image having excellent image quality and being free from development ghosts, by arranging the surface structure of a developer carrier.

Another object of the present invention is to provide a developing apparatus using the developer carrier.

Still another object of the present invention is to provide a developer carrier which has environmental stability to such an extent as to be able to provide excellent image quality even under both high temperature and high humidity conditions and low temperature and low humidity conditions; and which has excellent durability such that a filming, e.g., sticking of a developer, is not caused even when the developer carrier is repeatedly used.

A further object of the present invention is to provide a developing apparatus using the above-described developer carrier.

Other objects and effects of the present invention will be apparent from the following description.

The above objects of the present invention have been achieved by providing:

(1) a developer carrier comprising a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked; and (2) a developing apparatus which comprises a developer carrier for retaining a developer on the surface thereof and for conveying the developer onto the position at which an electrostatic latent image formed on a latent image carrier is developed, wherein the developer carrier comprises a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked.

BRIEF DESCRIPTION OF THE DRAWINGS

FIG. 3(*b*) is a plot illustrating the relationship between a weight-average molecular weight of a phenolic resin, as determined before being crosslinked, for use in a coating layer of a developer carrier and an image density under a high temperature and high humidity condition;

FIG. 4(*b*) is a plot illustrating the relationship between a weight-average molecular weight of a phenolic resin, as determined before being crosslinked, for use in a coating layer of a developer carrier and a development ghost level under a low temperature and low humidity condition;

FIG. 7(*b*) is a photograph, as a substitute for a drawing, which illustrates the analysis result of the surface state of the developer shown in FIG. 7(*a*) by RD-500 three-dimensional geometrical analyzer;

FIG. 8(*b*) is a photograph, as a substitute for a drawing, which illustrates the analysis result of the surface state of the developer shown in 8(*a*) by RD-500 three-dimensional geometrical analyzer;

FIG. 9(*b*) is a photograph, as a substitute for a drawing, which illustrates the analysis result of the surface state of the developer shown in FIG. 9(*a*) by RD-500 three-dimensional geometrical analyzer.

DETAILED DESCRIPTION OF THE INVENTION

Figure 1:
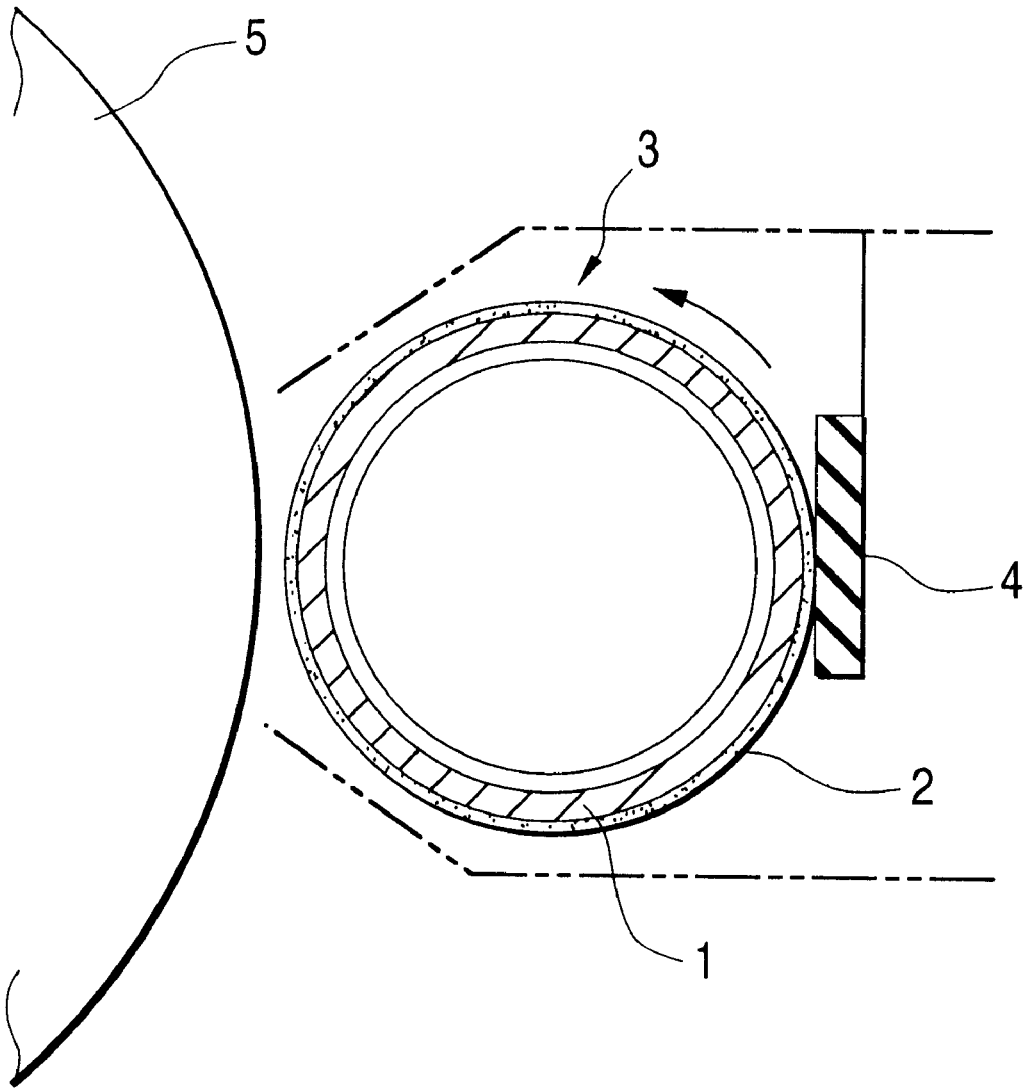
FIG. 1 is a schematic representation illustrating a developer carrier and a developing apparatus using the same according to the present invention.

As illustrated in FIG. 1, a developer carrier 3 of the present invention comprising a cylindrical support 1 having provided the outer surface thereof a coating layer 2 to cover the cylindrical support. In the developer carrier 3, a developer is retained on the surface of the coating layer 2. The coating layer 2 is a resin layer comprising electrically conductive fine particles and a binder resin. The binder resin of the resin layer is a phenolic resin having a weight-average molecular weight of from 3,000 to 5,000, as determined before being crosslinked.

In such a technological means, the developer carrier 3 of the present invention is only required to have at least the cylindrical support 1 and the coating layer 2. The shape and state (e.g., a stationary or rotative state) of a magnetic member for generating a magnetic field disposed inside the developer carrier, and a layout pattern of magnetic poles, may be appropriately redesigned.

The surface of the developer carrier 3 has a resin layer containing conductive fine particles, as described above. Examples of the conductive fine particles include, e.g., carbon compounds such as carbon black, graphite and carbon fiber; powder of metals such as copper and silver; and electrically conductive whiskers such as conductive potassium titanate. The content of the conductive fine particles in the coating layer is preferably 50 to 90 parts by weight per 100 parts by weight of the binder resin in the coating layer. For example, 20 parts by weight of carbon black and 50 parts by weight of graphite are added to 100 parts by weight of the binder resin to prepare the coating layer.

The phenolic resin for use in the coating layer has a weight-average molecular weight as determined before being crosslinked (hereinafter referred to as "weight-average molecular weight (Mw)") of 3,000 to 5,000. If the weight-average molecular weight (Mw) of the phenolic resin is below 3,000, the dispersibility of the conductive fine particles will be deteriorated. As a result, an appropriate resistance cannot be obtained. In contrast, if the weight-average molecular weight (Mw) exceeds 5,000, the conductive fine particles become less likely to adsorb the resin. As a result, the conductive fine particles become apt to coagulate, thereby making it difficult to provide an appropriate resistance.

Figure 5:
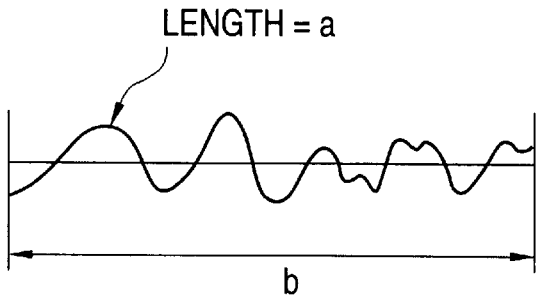
FIG. 5 is a diagrammatic representation of an effective line length (SRlr) as an index of the surface roughness of a developer carrier.

As a result of investigation of the relationship between the weight-average molecular weight (Mw) of the phenolic resin and an effective line length (SRlr) (i.e., a quotient (expressed as a percentage) resulting from division of the entire length (a) of a profile curve by the section length (b) as shown in FIG. 5) which serves as an index of the surface roughness of the crosslinked developer carrier 3, it was observed that as the weight-average molecular weight (Mw) increased, the effective line length (SRlr) decreased in an inversely proportional manner. Provided that the weight-average molecular weight Mw of the phenolic resin is 3,000, it was found that the effective line length (SRlr), as an index of the surface roughness of the crosslinked developer carrier 3, was 108.00.

Consequently, in the present invention, the requirement with respect to the phenolic resin to have a weight-average molecular weight (Mw) of from 3,000 to 5,000 are almost equivalent to a requirement to have an effective line length (SRlr), as an index of a surface roughness of the crosslinked developer carrier 3, of 108.00 or less.

The present invention also relates to a developing apparatus comprising the developer carrier 3 which is as shown in FIG. 1. In the developing apparatus, a developer is retained on the surface of the developer carrier 3 and is carried to a development position where an electrostatic latent image formed on the latent image carrier 5 is developed.

This type of developing apparatus is generally provided with the layer thickness regulating member 4 for regulating the thickness of a developer layer formed on the developer carrier 3. This layer thickness regulating member 4 is an elastic substance comprising a urethane rubber. The urethane rubber preferably has a hardness of from 55° to 75° as determined according to JIS-A.

If the hardness of the urethane rubber exceeds 75°, formation of a developer layer becomes deteriorated. Eventually, it becomes difficult to carry a developer in an amount necessary to carry out a developing operation, to thereby cause image density unevenness. In contrast, if the hardness of the urethane rubber is less than 55°, the layer thickness regulating member 4 is damaged because of its softness. Eventually, white strips are caused on a resultant image.

The effects of the above-described technical means are described below.

The developer carrier 3 of the present invention has the coating layer 2 comprising a resin layer containing the conductive fine particles. A phenolic resin having a weight-average molecular weight (Mw) ranging from 3,000 to 5,000 is used as the binder resin of the resin layer.

By taking the above-described constitution, the phenolic resin as the binder resin is uniformly dispersed, so that the conductive fine particles do not aggregate. Therefore, the phenolic resin maintains good dispersibility of the conductive fine particles dispersed therein, and provides an appropriate resistance.

In the present invention, the coating layer 2 comprises a resin layer comprising conductive fine particles, and the binder resin of the resin layer is limited to a phenolic resin having a weight-average molecular weight as determined before being crosslinked (Mw) of from 3,000 to 5,000. However, it is considered that other binder resins (e.g., acrylic resins, xylene resins, fluororesins, silicon resins, and polyester resins) may provide effects similar to those obtained by the present invention so long as molecular weights as determined before being crosslinked (Mw) of these resins are selected so as to fall within the respective inherent range thereof.

PREFERRED EMBODIMENTS OF THE PRESENT INVENTION

With reference to several embodiments shown in the accompanying drawings, the present invention is described in detail below.

Figure 2:
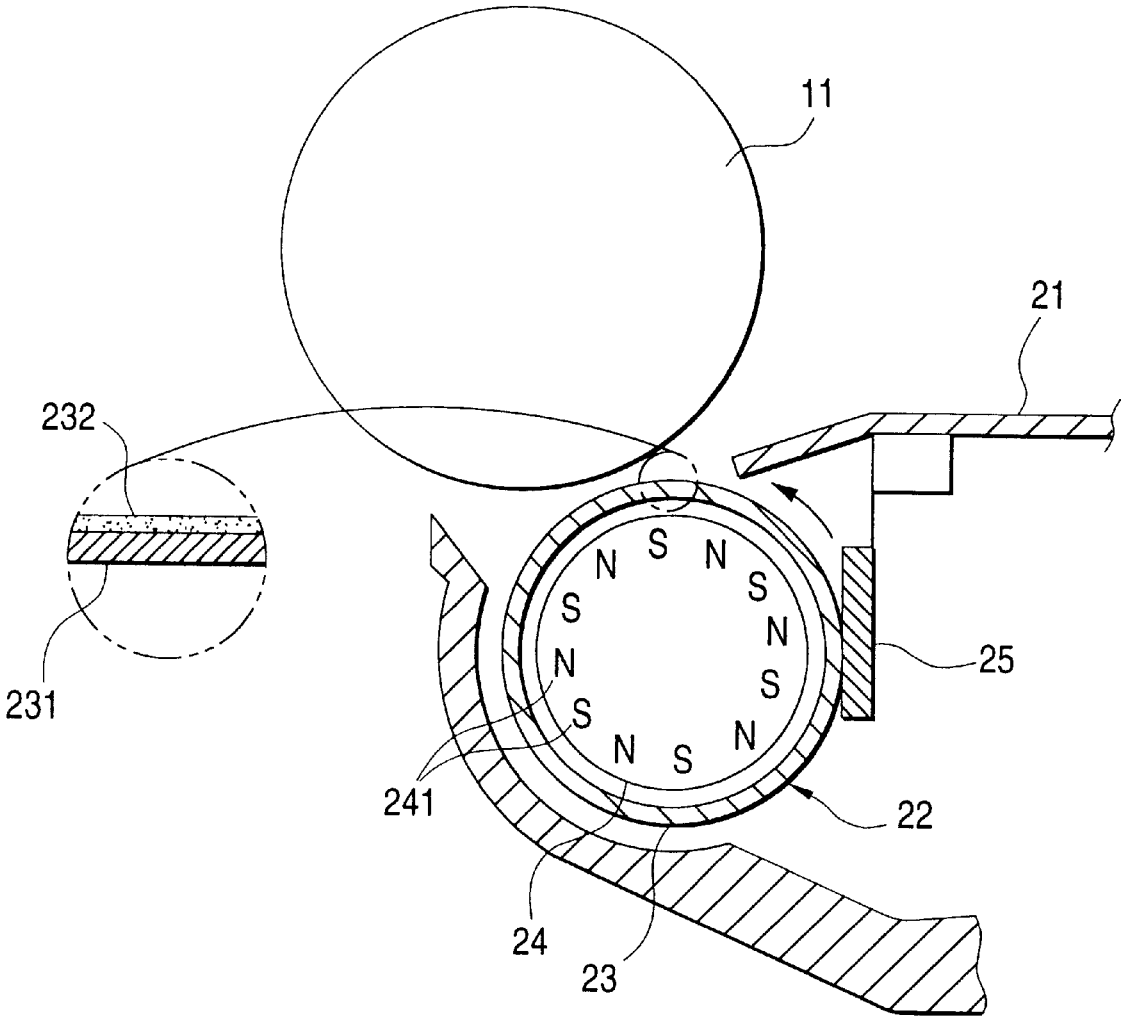
FIG. 2 is a schematic representation illustrating an embodiment of a developing apparatus to which the present invention is applied.
Figure 4A:
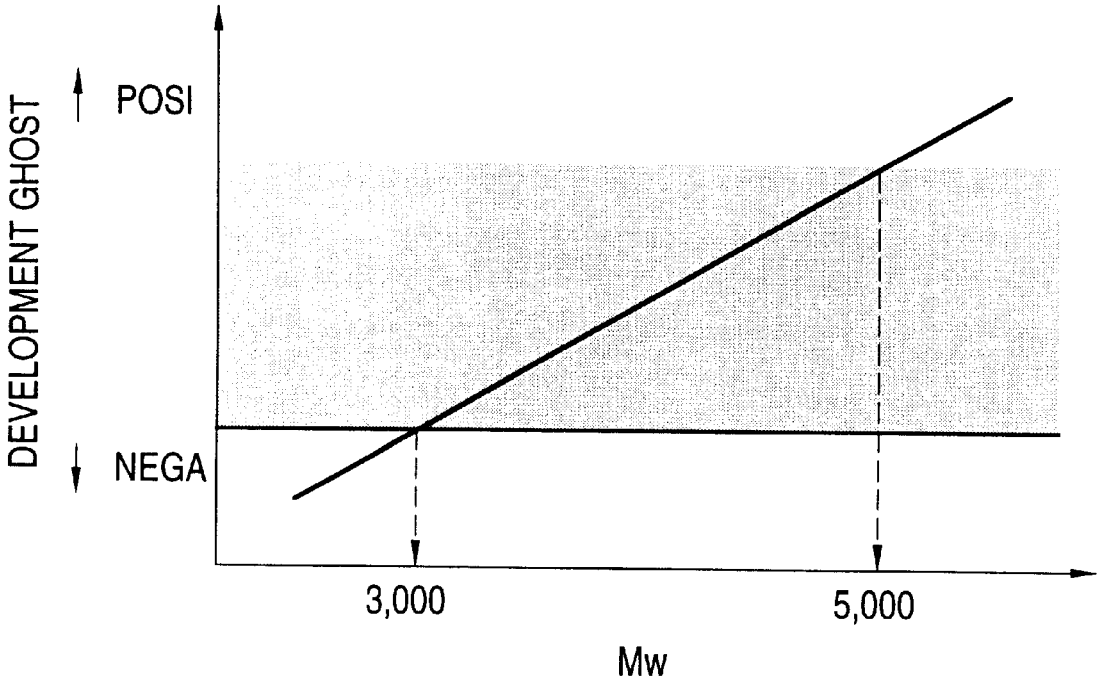
FIG. 4(*a*) is a plot illustrating the relationship between a weight-average molecular weight of a phenolic resin, as determined before being crosslinked, for use in a coating layer of a developer carrier and a development ghost level.

FIG. 2 illustrates an embodiment of a developing apparatus according to the present invention.

In the drawing, the developing apparatus has a development housing 21 which is opened so as to be opposite to a latent image carrier 11 such as a photosensitive drum. This development housing 21 stores a magnetic one-component developer (dry silica is externally added thereto), and a developer carrier (a development roll) 22 is disposed in the development housing 21 so as to face the opening of the development housing 21.

In the present embodiment, the developer carrier 22 comprising a rotative cylindrical sleeve 23, and a magnetic roll 24 fixedly disposed in the cylindrical sleeve 23. A plurality of magnetic poles 241 are arranged within the magnetic roll 24 so as to form a magnetic pattern for carrying the developer.

For example, the following sleeve can be used for the cylindrical sleeve 23.

That is, the cylindrical sleeve 23 may be made by applying a resin fluid having the following formulation to, e.g, an aluminum pipe 231 for use as the support and then heating and curing the thus-coated resin fluid in a heat drying furnace, to form a coating layer 232.

Formulation of Resin Fluid:

Binder Resin: Phenolic resin having a weight-average molecular weight, as determined before being crosslinked, of from 3,000 to 5,000

Conductive Particle: Known materials such as carbon black or graphite

Diluting Solvent: Known material such as propyleneglycol monomethylether or isopropyl-alcohol The cylindrical sleeve 23 can be manufactured by use of a known method, e.g., dip-coating or roll-coating.

The base end of the layer thickness regulating member 25 is mounted on the development housing 21. The layer thickness regulating member 25 is brought into contact with the development carrier 22 so that a predetermined elastic force is applied, whereby the thickness of a developer layer formed on the developer carrier 22 is regulated.

A rubber blade made of urethane rubber is used as the layer thickness regulating member 25 in the present embodiment. The hardness of the urethane rubber for use herein preferably ranges from 55° to 75° as determined according to JIS-A (hardness Hs) (Asuka C).

A doctor blade system is employed in the present embodiment, so that the free end of the layer thickness regulating member 25 is directed so as to be opposite to the direction of rotation of the developer carrier 22. However, it is also possible to employ a wiper blade system in which the free end of the layer thickness regulating member 25 is guided along the direction of rotation of the developer carrier 22.

By virtue of the present embodiment, as is obvious from the results of the following Examples and comparative Examples, the dispersibility of conductive fine particles is increased by adjusting the weight-average molecular weight, as determined before being crosslinked, (Mw) of phenolic resin to the range of 3,000 to 5,000. As a result, the conductive fine particles are prevented from aggregation, which in turn makes it possible to provide an appropriate resistance, and thus an image having excellent image quality.

Further, an image having excellent image quality free from density unevenness and white strips is obtained by employing a urethane rubber having a hardness of from 55° to 75°, as determined according to JIS-A (hardness Hs) (Asuka C), as the layer thickness regulating member 25.

The present invention will be described in more detail with reference to the following Examples and comparative Examples, but the invention should not be construed as being limited thereto. All parts are by weight unless otherwise indicated.

EXAMPLE 1

A resin fluid having the following formulation was applied to an aluminum pipe by spray-coating.

| Formulation of Resin Fluid: | |
|---|---|
| Binder Resin: | |
| Phenolic resin (Mw = 3200*) | 100 parts |
| Conductive Particle: | |
| Carbon Black | 20 parts |
| Graphite | 50 parts |
| Diluting Agent: | |
| Propyleneglycol monomethylether | 100 parts |
| Isopropyl-alcohol | 150 parts |

*) Mw used in Examples represents a molecular weight as determined before being crosslinked.

The resin fluid having the above-described formulation was dispersed by a sand mill, and the thus-dispersed resin fluid was applied to the aluminum pipe by spraying. The thus coated resin fluid was heated and cured in a heat drying furnace at a temperature of 160° C. for thirty minutes, to prepare a developer carrier according to the present invention. The developer carrier has a specific resistance of $5.1\times10^{-2}$ (Ω•cm), a surface roughness (Ra) of 1.1 μm, and an effective line length (SRlr) of 107.61.

The hardness of a urethane rubber that was used as the member for regulating the thickness of a developer layer was 58°.

Print tests were carried out in each of the environmental conditions of (1) an ordinary temperature and ordinary humidity condition (25° C., 45% RH), (2) a low temperature and low humidity condition (10° C., 15% RH) and (3) a high temperature and high humidity condition (30° C., 85% RH), while the developer carrier and the developer layer thickness regulating member were incorporated into a laser printer FX4109 (manufactured by Fuji Xerox Co, Ltd.). Image densities of print samples were measured by a device Model 1404A manufactured by X-Rite corporation, and development ghosts were visually evaluated.

EXAMPLE 2

A developer carrier according to the present invention was prepared in the same manner as in Example 1, except that the binder resin was changed with one having an Mw of 4,200. The developer carrier has a specific resistance of $11.2\times10^{-2}$ (Ω•cm), a surface roughness (Ra) of 1.3 μm, and an effective line length (SRlr) of 103.80.

The hardness of a urethane rubber that was used as the member for regulating the thickness of the developer layer was 65°.

The same image quality evaluation as in Example 1 was carried out using the developer carrier and the developer layer regulating member as incorporated into the laser printer FX4109.

EXAMPLE 3

A developer carrier according to the present invention was prepared in the same manner as in Example 1, except that the binder resin was changed with one having an Mw of 4,500. The developer carrier has a specific resistance of $12.5\times10^{-2}$ (Ω•cm), a surface roughness (Ra) of 1.4 μm, and an effective line length (SRlr) of 102.91.

The hardness of a urethane rubber that was used as the member for regulating the thickness of the developer layer was 70°.

The same image quality evaluation as in Example 1 was carried out using the developer carrier and the developer layer regulating member as incorporated into the laser printer FX4109.

EXAMPLE 4

A developer carrier according to the present invention was prepared in the same manner as in Example 1, except that the binder resin was changed with one having an Mw of 4,800. The developer carrier has a specific resistance of $16.8\times10^{-2}$ (Ω•cm), a surface roughness (Ra) of 1.5 μm, and an effective line length (SRlr) of 102.00.

The hardness of a urethane rubber that was used as. the member for regulating the thickness of the developer layer was 73°.

The same image quality evaluation as in Example 1 was carried out using the developer carrier and the developer layer regulating member as incorporated into the laser printer FX4109.

EXAMPLE 5

A developer carrier according to the present invention was prepared in the same manner as in Example 1, except that the binder resin was changed with one having an Mw of 3,800. The developer carrier has a specific resistance of $8.6\times10^{-2}$ (Ω•cm), a surface roughness (Ra) of 1.8 μm, and an effective line length (SRlr) of 106.05.

The hardness of a urethane rubber that was used as the member for regulating the thickness of the developer layer was 68°.

The same image quality evaluation as in Example 1 was carried out using the developer carrier and the developer layer regulating member as incorporated into the laser printer FX4109.

EXAMPLE 6

A developer carrier according to the present invention was prepared in the same manner as in Example 1, except that the binder resin was changed with one having an Mw of 3,200. The developer carrier has a specific resistance of $4.7\times10^{-2}$ (Ω•cm), a surface roughness (Ra) of 1.1 μm, and an effective line length (SRlr) of 107.11.

The hardness of a urethane rubber that was used as the member for regulating the thickness of the developer layer was 72°.

The same image quality evaluation as in Example 1 was carried out using the developer carrier and the developer layer regulating member as incorporated into the laser printer FX4109.

EXAMPLE 7

A developer carrier according to the present invention was prepared in the same manner as in Example 1, except that the binder resin was changed with one having an Mw of 3,500. The developer carrier has a specific resistance of $7.5\times10^{-2}$ (Ω•cm), a surface roughness (Ra) of 1.3 μm, and an effective line length (SRlr) of 106.60.

The hardness of a urethane rubber that was used as the member for regulating the thickness of the developer layer was 58°.

The same image quality evaluation as in Example 1 was carried out using the developer carrier and the developer layer regulating member as incorporated into the laser printer FX4109.

EXAMPLE 8

A developer carrier according to the present invention was prepared in the same manner as in Example 1, except that the binder resin was changed with one having an Mw of 3,900. The developer carrier has a specific resistance of $9.9\times10^{-2}$ (Ω•cm), a surface roughness (Ra) of 1.4 μm, and an effective line length (SRlr) of 105.98.

The hardness of a urethane rubber that was used as the member for regulating the thickness of the developer layer was 70°.

The same image quality evaluation as in Example 1 was carried out using the developer carrier and the developer layer regulating member as incorporated into the laser printer FX4109.

EXAMPLE 9

A developer carrier according to the present invention was prepared in the same manner as in Example 1, except that the binder resin was changed with one having an Mw of 4,500. The developer carrier has a specific resistance of $1.3\times10^{-1}$ (Ω•cm), a surface roughness (Ra) of 1.6 μm, and an effective line length (SRlr) of 102.61.

The hardness of a urethane rubber that was used as the member for regulating the thickness of the developer layer was 63°.

The same image quality evaluation as in Example 1 was carried out using the developer carrier and the developer layer regulating member as incorporated into the laser printer FX4109.

EXAMPLE 10

A developer carrier according to the present invention was prepared in the same manner as in Example 1, except that the binder resin was changed with one having an Mw of 4,900. The developer carrier has a specific resistance of $1.8\times10^{-1}$ (Ω•cm), a surface roughness (Ra) of 1.7 μm, and an effective line length (SRlr) of 101.85.

The hardness of a urethane rubber that was used as the member for regulating the thickness of the developer layer was 74°.

The same image quality evaluation as in Example 1 was carried out using the developer carrier and the developer layer regulating member as incorporated into the laser printer FX4109.

Comparative Example 1

A developer carrier was prepared in the same manner as in Example 1, except that the binder resin was changed with one having an Mw of 2,400. The developer carrier has a specific resistance of $2.1\times10^{0}$ (Ω•cm), a surface roughness (Ra) of 2.1 μm, and an effective line length (SRlr) of 114.01.

The hardness of a urethane rubber that was used as the member for regulating the thickness of the developer layer was 81°.

The same image quality evaluation as in Example 1 was carried out using the developer carrier and the developer layer regulating member as incorporated into the laser printer FX4109.

Comparative Example 2

A developer carrier was prepared in the same manner as in Example 1, except that the binder resin was changed with one having an Mw of 5,200. The developer carrier has a specific resistance of $3.2\times10^{0}$ (Ω•cm), a surface roughness (Ra) of 2.0 μm, and an effective line length (SRlr) of 103.05.

The hardness of a urethane rubber that was used as the member for regulating the thickness of the developer layer was 79°.

The same image quality evaluation as in Example 1 was carried out using the developer carrier and the developer layer regulating member as incorporated into the laser printer FX4109.

Comparative Example 3

A developer carrier was prepared in the same manner as in Example 1, except that the binder resin was changed with one having an Mw of 2,200. The developer carrier has a specific resistance of $1.2\times10^{0}$ (Ω•cm), a surface roughness (Ra) of 2.1 μm, and an effective line length (SRlr) of 115.03.

The hardness of a urethane rubber that was used as the member for regulating the thickness of the developer layer was 66°.

The same image quality evaluation as in Example 1 was carried out using the developer carrier and the developer layer regulating member as incorporated into the laser printer FX4109.

Comparative Example 4

A developer carrier was prepared in the same manner as in Example 1, except that the binder resin was changed with one having an Mw of 3,600. The developer carrier has a specific resistance of $8.5\times10^{-2}$ (Ω•cm), a surface roughness (Ra) of 2.2 μm, and an effective line length (SRlr) of 106.04.

The hardness of a urethane rubber that was used as the member for regulating the thickness of the developer layer was 84°.

The same image quality evaluation as in Example 1 was carried out using the developer carrier and the developer layer regulating member as incorporated into the laser printer FX4109.

Comparative Example 5

A developer carrier was prepared in the same manner as in Example 1, except that the binder resin was changed with one having an Mw of 5,300. The developer carrier has a specific resistance of $2.5\times10^{0}$ (Ω•cm), a surface roughness (Ra) of 2.2 μm, and an effective line length (SRlr) of 102.80.

The hardness of a urethane rubber that was used as the member for regulating the thickness of the developer layer was 58°.

The same image quality evaluation as in Example 1 was carried out using the developer carrier and the developer layer regulating member as incorporated into the laser printer FX4109.

Comparative Example 6

A developer carrier was prepared in the same manner as in Example 1, except that the binder resin was changed with one having an Mw of 4,000. The developer carrier has a specific resistance of $10.8\times10^{-2}$ (Ω•cm), a surface roughness (Ra) of 1.2 μm, and an effective line length (SRlr) of 105.00.

The hardness of a urethane rubber that was used as the member for regulating the thickness of the developer layer was 44°.

The same image quality evaluation as in Example 1 was carried out using the developer carrier and the developer layer regulating member as incorporated into the laser printer FX4109.

Comparative Example 7

A developer carrier was prepared in the same manner as in Example 1, except that the binder resin was changed with one having an Mw of 2,400. The developer carrier has a specific resistance of $2.1\times10^{0}$ (Ω•cm), a surface roughness (Ra) of 2.1 μm, and an effective line length (SRlr) of 115.00.

The hardness of a urethane rubber that was used as the member for regulating the thickness of the developer layer was 49°.

The same image quality evaluation as in Example 1 was carried out using the developer carrier and the developer layer regulating member as incorporated into the laser printer FX4109.

Comparative Example 8

A developer carrier was prepared in the same manner as in Example 1, except that the binder resin was changed with one having an Mw of 5,800. The developer carrier has a specific resistance of $7.7\times10^{0}$ (Ω•cm), a surface roughness (Ra) of 0.5 μm, and an effective line length (SRlr) of 102.05.

The hardness of a urethane rubber that was used as the member for regulating the thickness of the developer layer was 50°.

The same image quality evaluation as in Example 1 was carried out using the developer carrier and the developer layer regulating member as incorporated into the laser printer FX4109.

The evaluation results of image quality of Examples 1 to 10 and comparative Examples 1 to 8 are shown in Table 1 below.

The symbols E, G, F and B used in Table 1, respectively, represent the followings:

E: Substantially no image defects were observed

G: Slight image defects were observed

F: Image defects were observed but is practically acceptable

B: Considerable image defects were observed

Further, in the column headed by "Density unevenness/white strips", "-" represents that neither density unevenness nor white strips observed, "U" represents the occurrence of density unevenness, and "W" represents the occurrence of white strips.

TABLE 1

| | 25° C., 45% RH | | | | 10° C., 15% RH | | | | 30° C., 85% RH | | | |
|---|---|---|---|---|---|---|---|---|---|---|---|---|
| | Image density | Ghost | Leak | Density unevenness/ white strips | Image density | Ghost | Leak | Density unevenness/ white strips | Image density | Ghost | Leak | Density unevenness/ white strips |
| Ex. Nos. | | | | | | | | | | | | |
| 1 | 1.41 | G | G | — | 1.45 | G | G | — | 1.42 | E | G | — |
| 2 | 1.52 | E | G | — | 1.54 | E | G | — | 1.50 | E | G | — |
| 3 | 1.54 | E | G | — | 1.55 | E | G | — | 1.51 | E | G | — |
| 4 | 1.41 | G | G | — | 1.43 | G | G | — | 1.40 | E | G | — |
| 5 | 1.40 | G | G | — | 1.42 | G | G | — | 1.40 | E | G | — |
| 6 | 1.42 | G | G | — | 1.43 | F | G | — | 1.41 | E | G | — |
| 7 | 1.44 | E | G | — | 1.45 | G | G | — | 1.42 | E | G | — |
| 8 | 1.48 | E | G | — | 1.49 | G | G | — | 1.48 | E | G | — |
| 9 | 1.45 | E | G | — | 1.46 | G | G | — | 1.44 | E | G | — |
| 10 | 1.49 | G | G | — | 1.50 | F | G | — | 1.49 | E | G | — |
| Compara. Ex. Nos. | | | | | | | | | | | | |
| 1 | 1.42 | F | G | U | 1.45 | F | G | U | 1.24 | G | F | U |
| 2 | 1.42 | F | G | U | 1.44 | B | G | U | 1.25 | G | F | U |
| 3 | 1.41 | F | G | — | 1.43 | F | G | — | 1.28 | G | F | — |
| 4 | 1.43 | F | G | U | 1.44 | F | G | U | 1.26 | G | F | U |
| 5 | 1.45 | F | G | — | 1.46 | B | G | — | 1.32 | G | F | — |
| 6 | 1.44 | F | G | W | 1.45 | F | G | W | 1.24 | G | F | W |
| 7 | 1.42 | F | G | W | 1.43 | F | F | W | 1.26 | F | F | W |
| 8 | 1.41 | F | F | W | 1.45 | B | F | W | 1.29 | F | F | W |

Figure 3A:
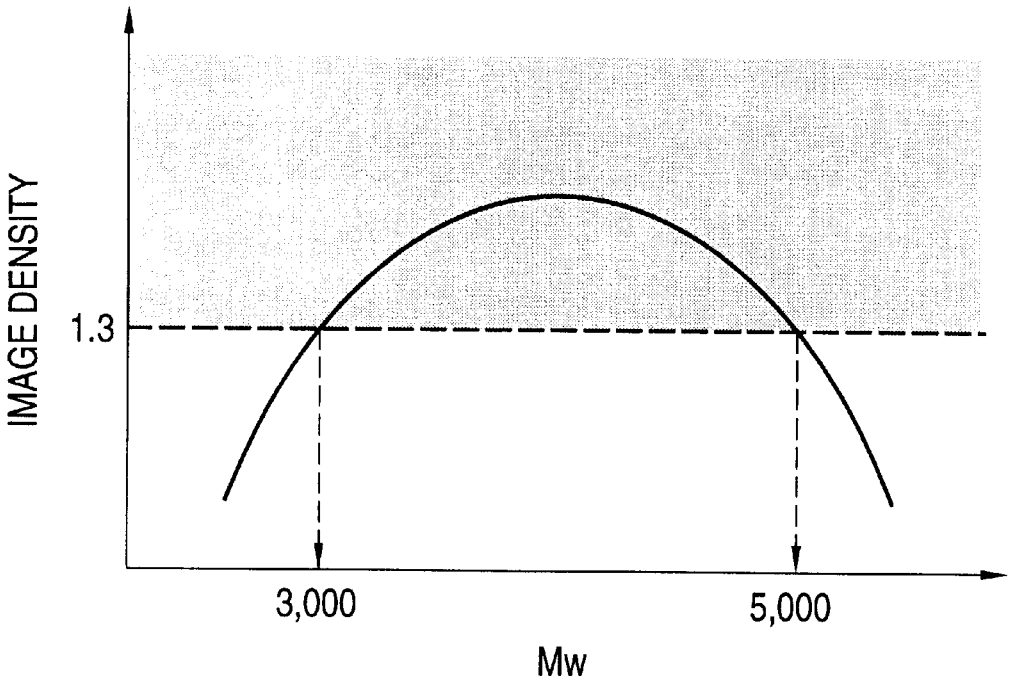
FIG. 3(*a*) is a plot illustrating the relationship between a weight-average molecular weight of a phenolic resin, as determined before being crosslinked, for use in a coating layer of a developer carrier and an image density.
Figure 3:
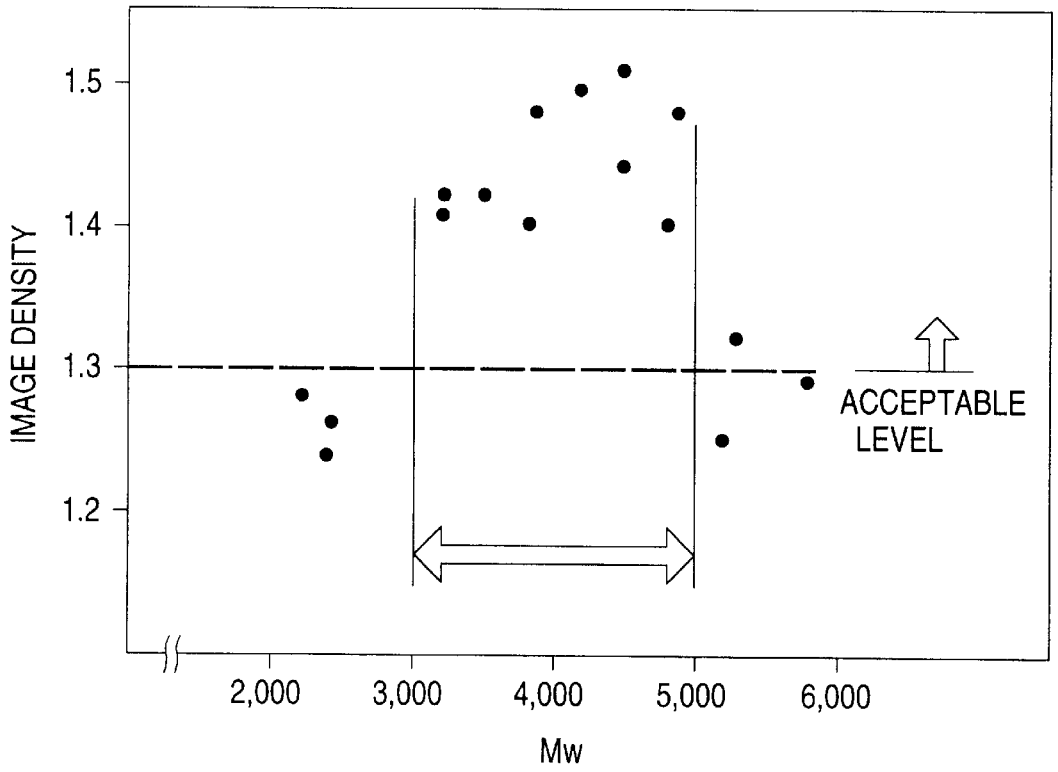

FIGS. 3(*a*) and 3(*b*) show the result of investigation of the relationship between the Mw of a phenolic resin and an image density (an optical density) provided in Table 1. The crosshatched area in FIG. 3(*a*) designates an area in which the Mw is within from 3,000 to 5,000 and an image density is 1.3 or more.

Figure 4:
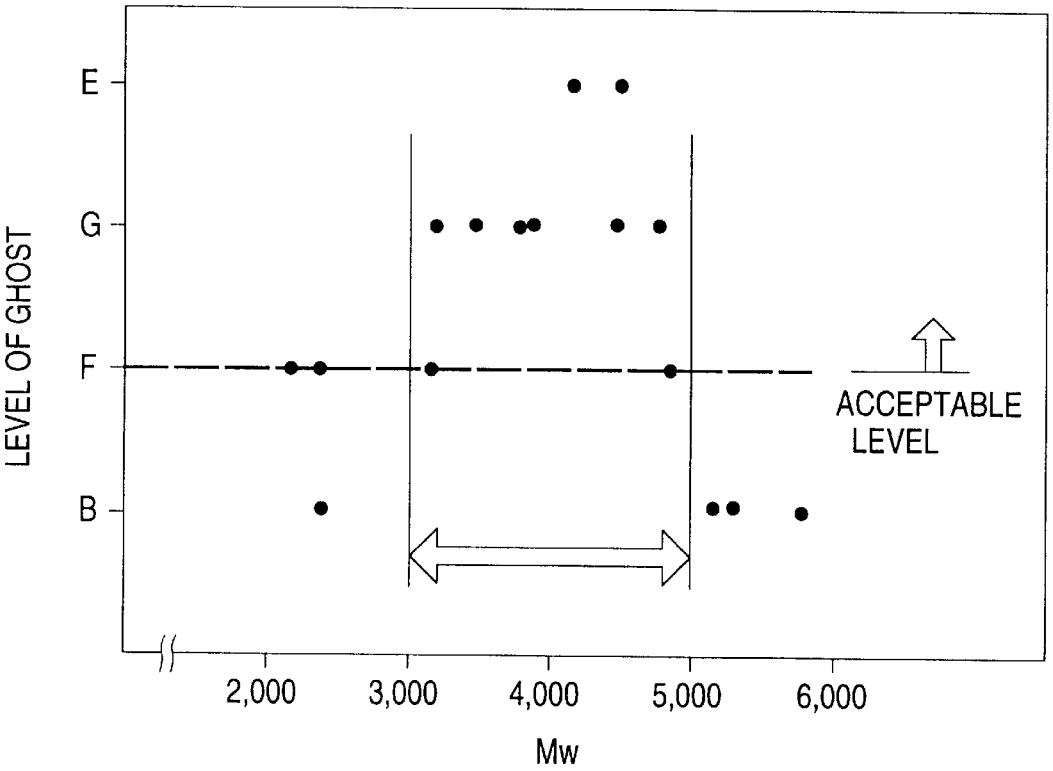

FIGS. 4(*a*) and 4(*b*) show the result of investigation of the relationship between the Mw of a phenolic resin and the occurrence of development ghosts provided in table 1. The crosshatched area shown in FIG. 4(*a*) designates a development-ghost-free area having an Mw of 3,000 to 5,000.

As is clear from table 1, FIGS. 3(*a*) and 3(*b*), FIGS. 4(*a*) and 4(*b*), it was possible to impart an appropriate electrostatic charge amount to the developer, and therefore resultant image density, development ghosts and leaks provided no practical problems, in each environmental conditions in each Inventive Examples (i.e., when the Mw of a phenolic resin range is within from 3,000 to 5,000, and the hardness of a rubber constituting the layer thickness regulating member is within from 55° to 75°).

Particularly, in Example 2 (Mw=4,200, and a hardness of 65°), Example 3 (Mw=4,500, and a hardness of 70°), Example 7 (Mw=3,500, and a hardness of 58°), Example 8 (Mw=3,900, and a hardness of 70°) and Example 9 (Mw=4,500, and a hardness of 63°), high image density was obtained even in a high temperature and high humidity condition. Further, even in a low temperature and low humidity condition, substantially no development ghosts developed. Thus, particularly excellent results were obtained.

In view of the above described results of the Examples, the developing apparatus preferably have an Mw of a phenolic resin ranging from 3,500 to 4,500 and a hardness of a urethan rubber ranging from 60° to 70°.

In each of the above described Examples and comparative Examples, there was investigated the relationship between the Mw of the phenolic resin and the effective line length (SRlr) which indicates the surface roughness of the crosslinked developer carrier. Results as provided in FIG. 6 were obtained.

As shown in FIG. 5, the effective line length SRlr indicating the surface roughness of the crosslinked developer carrier is a quotient, which is expressed by percentage, resulting from division of the entire length "a" of the profile curve by the section length "b".

Figure 6:
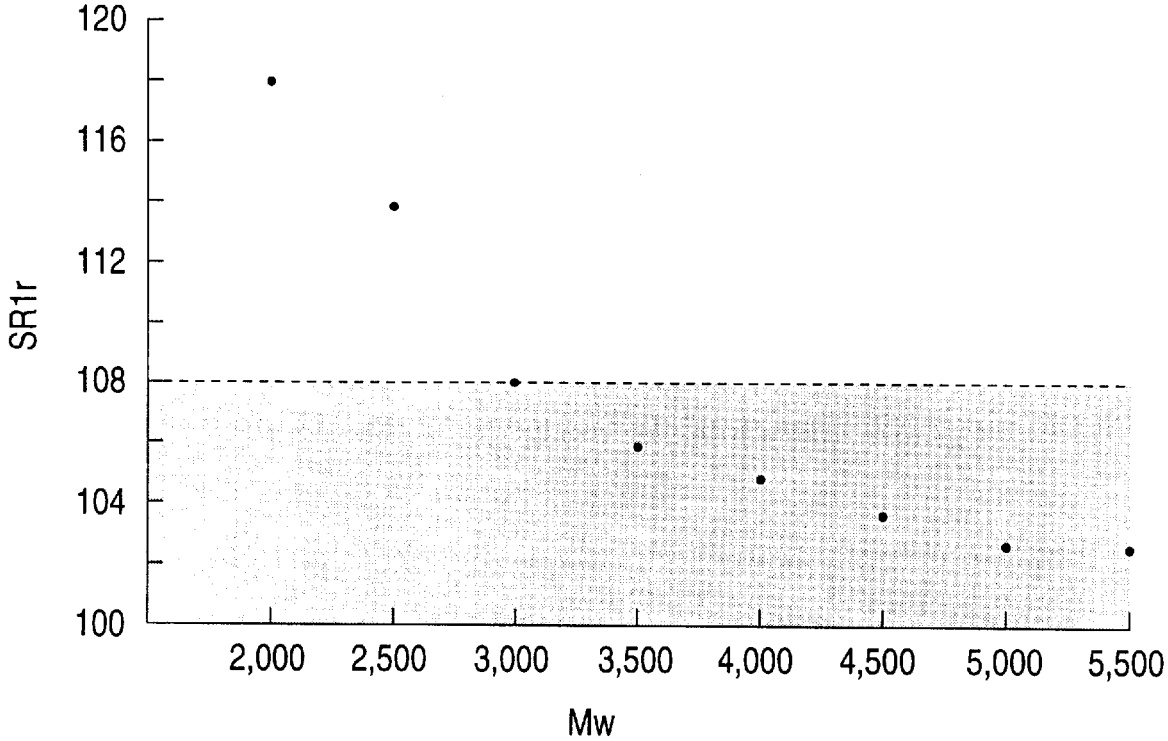
FIG. 6 is a plot illustrating the relationship between a weight-average molecular weight of a phenolic resin, as determined before being crosslinked, for use in a coating layer of a developer carrier and an effective line length (SRlr) as the surface roughness of a developer carrier.

According to FIG. 6, it was acknowledged that there was a tendency for the effective line length SRlr as an index of the surface roughness, to decrease in an inversely proportional manner as the Mw of a phenolic resin increases.

Because such a result that SRlr=108.00 was obtained when Mw=3,000 was obtained, it is understood that if a phenolic resin having at least an Mw ranging from 3,000 to 5,000 is used, the effective line length SRlr (index of the surface roughness) becomes 108.00 or less.

Further, the surface states of three developer carriers in which three types of phenolic resins were used and each had an Mw of 3,000, 3,800 and 4,500, respectively, were photographed with a secondary electron image magnified 10.0k (i.e., 10,000) times (at the direction of 0° (i.e., from right above) by a scanning electron microscope (SEM). The results obtained are shown in FIGS. 7(*a*), 8(*a*) and 9(*a*).

Further, the thus obtained surface states of the developer carriers for each of the cases was analyzed with RD-500 Three-dimensional geometrical analyzer (Denshi Kogaku Kenkyujo Corp.). The results of the analysis are shown in FIGS. 7(*b*), 8(*b*) and 9(*b*).

Figure 7:
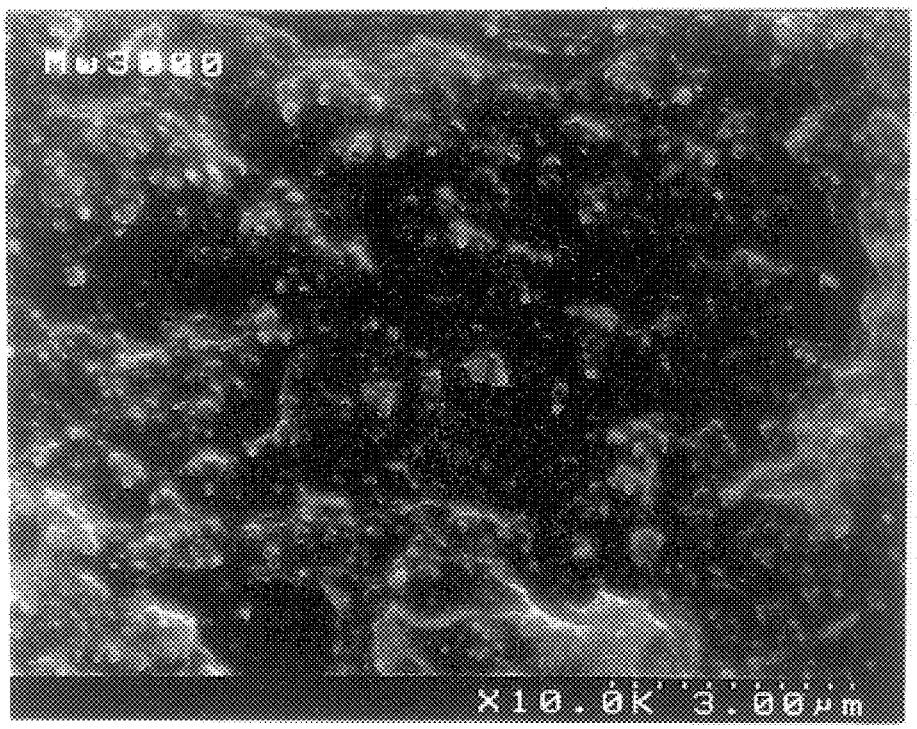
FIG. 7(*a*) is a photograph, as a substitute for a drawing, which was taken by a scanning electron microscope and shows a surface state of the developer carrier that contains a phenolic resin having a weight-average molecular weight of 3,000 as determined before being crosslinked.
Figure 7:
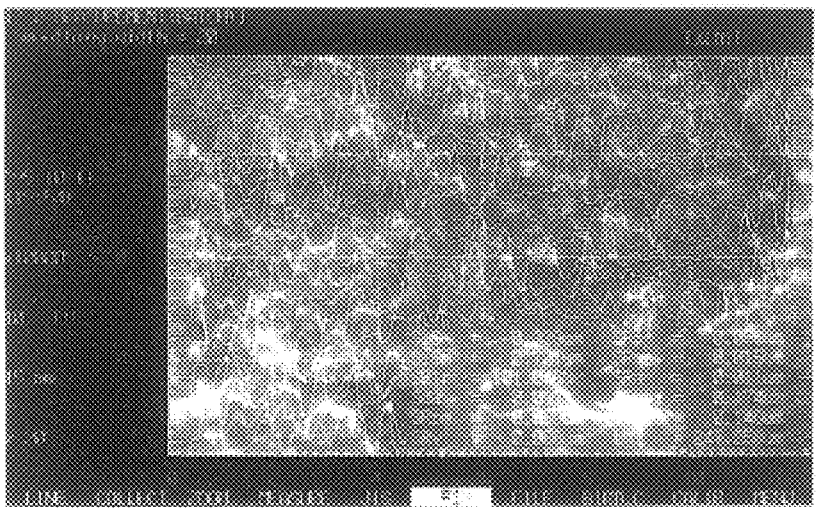
Figure 8:
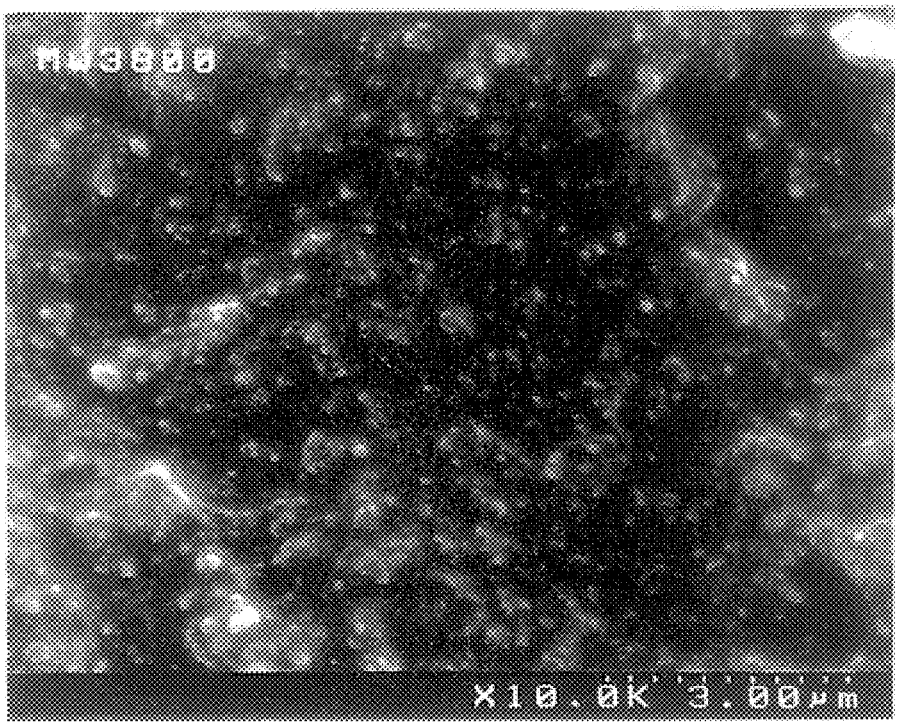
FIG. 8(*a*) is a photograph, as a substitute for a drawing, which was taken by a scanning electron microscope and shows a surface state of the developer carrier that contains a phenolic resin having a weight-average molecular weight of 3,800 as determined before being crosslinked.
Figure 8:
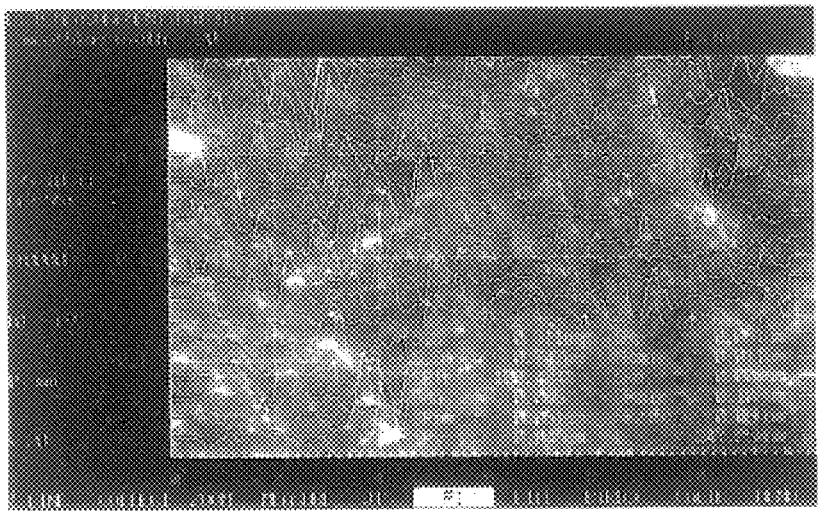
Figure 9:
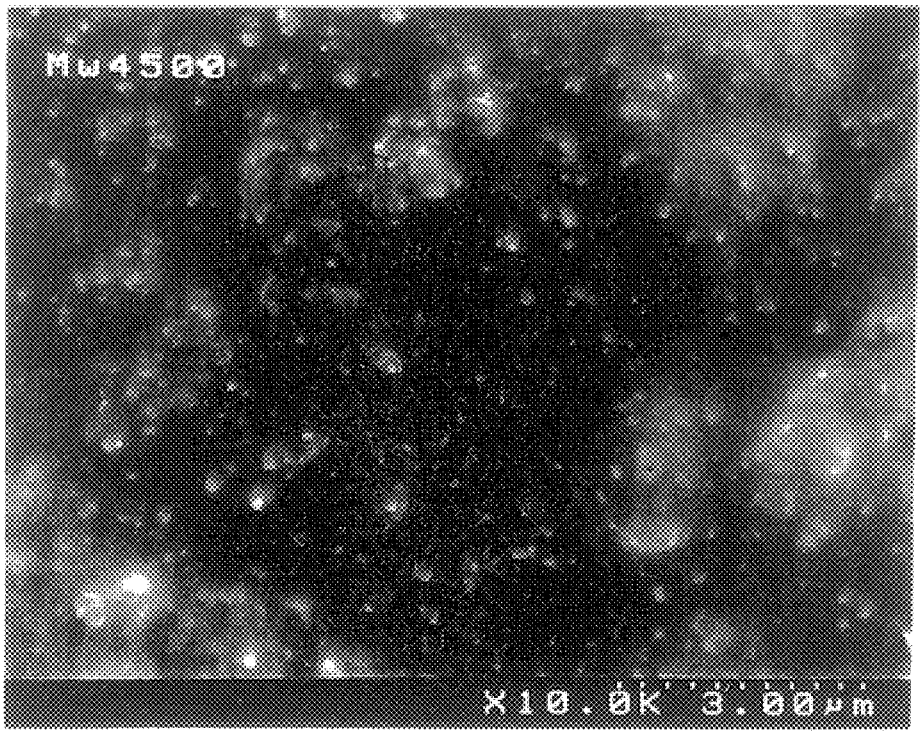
FIG. 9(*a*) is a photograph, as a substitute for a drawing, which was taken by a scanning electron microscope and shows a surface state of the developer carrier that contains a phenolic resin having a weight-average molecular weight of 4,500 as determined before being crosslinked.
Figure 9:
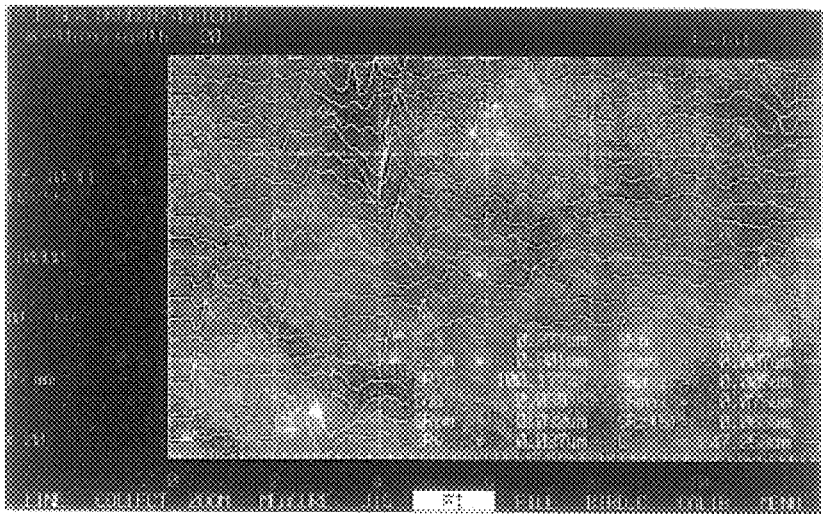

From the drawings FIGS. 7(*a*) and 7(*b*), 8(*a*) and 8(*b*), and 9(*a*) and 9(*b*), it can be seen that the conductive fine particles (corresponding to white areas in the drawings) are uniformly dispersed without aggregating. Moreover, it is comprehended that the surface roughness of the developer carrier gradually decreases as the Mw increases.

As has been described above, a phenolic resin having a weight-average molecular weight, as determined before being crosslinked, ranging from 3,000 to 5,000 is used as the binder resin for conductive fine particles in the developer carrier of the present invention. Therefore, the conductive fine particles are uniformly dispersed without aggregating over the surface coating layer of the developer carrier, and hence an appropriate resistance can be readily obtained.

Therefore, an appropriate electrostatic charge amount can be uniformly imparted to a developer, and a high-quality image free from density unevenness, leaks and development ghosts can be reliably ensured.

Particularly, a developer carrier of the present invention and a developing apparatus using it, makes it possible to effectively prevent leaks and development ghosts even in low temperature and low humidity conditions. Further, a high image density can be ensured also in high temperature and high humidity conditions. In this way, the developer carrier and the developing apparatus of the present invention provide a high image density and have excellent environment stability.

Consequently, a sufficient image density can be ensured without being affected by ambient variations. In addition, a high-quality image free from density unevenness can be obtained with less leaks and development ghosts.

In the present invention, the requirement that the phenolic resin has a weight-average molecular weight as determined before being crosslinked (Mw) of from 3,000 to 5,000 corresponds to the requirement that the effective line length SRl, which indicates the surface roughness of the crosslinked developer carrier 3, is a predetermined value or less. Therefore, it is possible to evaluate the occurrence or absence of leaks and development ghosts, and suitability of the image density to a certain degree, using the effective line length, as a parameter for the surface roughness of the crosslinked developer carrier.

Further, when a urethane rubber having a hardness ranging from 55° to 75° according to JIS-A (hardness Hs) (Asuka C) is used in the developing apparatus of the present invention as the member for regulating the thickness of a developer layer, image defects accompanied with regulating action of the layer thickness regulating member, such as density unevenness and white strips, can be reliably prevented.

While the invention has been described in detail and with reference to specific embodiments thereof, it will be apparent to one skilled in the art that various changes and modifications can be made therein without departing from the spirit and scope thereof.

What is claimed is:

1. A developer carrier comprising a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked.

2. The developer carrier of claim 1, having a surface roughness of not more than 108.00 in terms of effective length (SRlr).

3. A developing apparatus which comprises a developer carrier for retaining a developer on the surface thereof and for conveying the developer onto the position at which an electrostatic latent image formed on a latent image carrier is developed, wherein the developer carrier comprises a cylindrical support having provided on the outer surface thereof a coating layer for retaining a developer, wherein the coating layer comprises electrically conductive fine particles and a binder resin comprising a phenolic resin having a weight-average molecular weight of from 3,000 to 5,000 as determined before being crosslinked.

4. The developing apparatus of claim 3, further comprising a layer thickness regulating member for regulating the thickness of a developer layer formed and retained on the surface of the developer carrier, wherein the layer thickness regulating member is an elastic body comprising a urethane rubber and having a hardness of from 55° to 75°.

5. The developer carrier of claim 1, having a surface roughness of from 1.1 to 1.8 $\mu$m in terms of Ra.

6. The developer carrier of claim 1, having a specific resistance of from $1.2\times10^{-2}$ to $1.8\times10^{-1}$ Ω•cm.

7. A developer carrier manufacturing method comprising the steps of:

dispersing a phenolic resin having a weight-average molecular weight of from 3000 to 5000 and electrically conductive fine particles in a diluting agent to prepare a resin fluid;

spray-coating an aluminum pipe with the resin fluid; and heating and curing the resin fluid coated on the aluminum pipe.

* * * * *